US005678642A

United States Patent [19]

Briggs et al.

[11] Patent Number: 5,678,642

[45] Date of Patent: Oct. 21, 1997

[54] DRILLING ARRANGEMENT AND DRILLING FEED MECHANISM

[76] Inventors: Roger Robarts Briggs, 23 Leyes Lane, Kenilworth, Warwickshire CU8 20D, United Kingdom; Jarmo Uolevi Leppanen, c/o 11 Junction Road, Industries North, Germiston, 1401, South Africa

[21] Appl. No.: 537,898

[22] PCT Filed: Apr. 19, 1994

[86] PCT No.: PCT/GB94/00828

§ 371 Date: Oct. 18, 1995

§ 102(e) Date: Oct. 18, 1995

[87] PCT Pub. No.: WO94/24408

PCT Pub. Date: Oct. 27, 1994

[30] Foreign Application Priority Data

Apr. 21, 1993 [ZA] South Africa ..... 93/2781

[51] Int. Cl.[6] ..... E21B 19/08

[52] U.S. Cl. ..... 175/19

[58] Field of Search ..... 175/19, 21, 22; 137/625.66; 173/42, 43, 44

[56] References Cited

U.S. PATENT DOCUMENTS

| | | | |
|---|---|---|---|
| 2,701,551 | 2/1955 | Gunning . | |
| 3,897,719 | 8/1975 | Tipton | 137/625.66 X |
| 4,553,612 | 11/1985 | Durham . | |

FOREIGN PATENT DOCUMENTS

| | | |
|---|---|---|
| 0 016 717 | 10/1980 | European Pat. Off. . |
| 530 015 | 6/1939 | United Kingdom . |

*Primary Examiner*—William P. Neuder
*Attorney, Agent, or Firm*—Kinney & Lange, P.A.

[57] ABSTRACT

A drilling arrangement wherein a cylinder of a multistage telescopic feed mechanism acts on a drill to move it in a first direction and two pistons extend from the cylinder only in a second direction opposite to the first direction, acting against a feed beam.

4 Claims, 2 Drawing Sheets

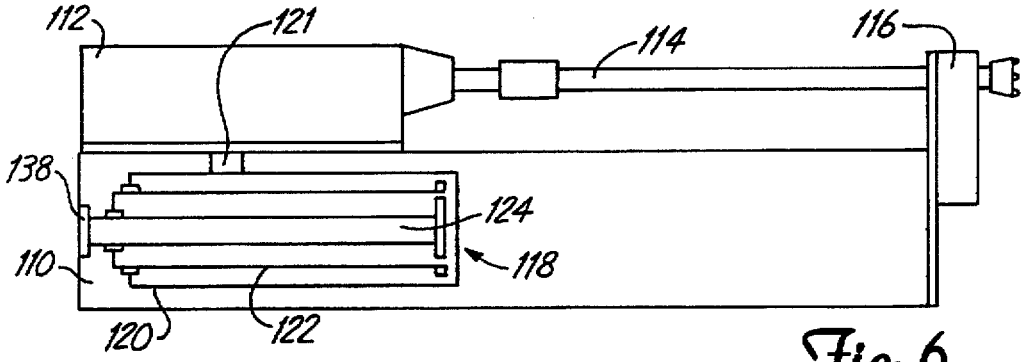
Fig. 6
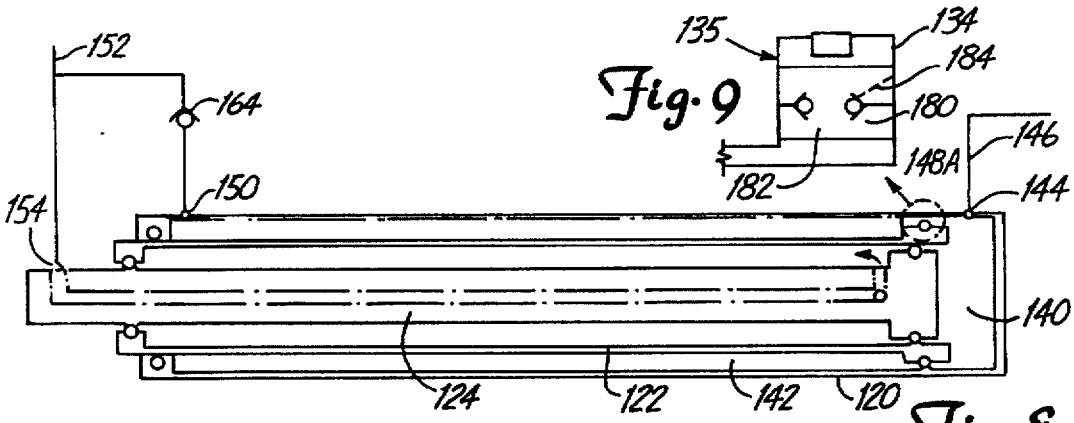
Fig. 9
Fig. 8
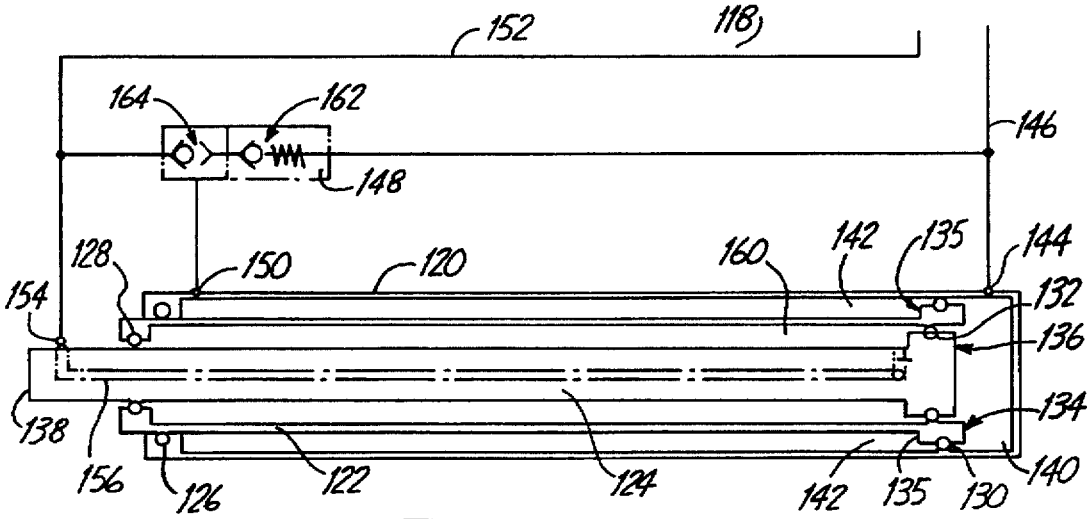
Fig. 7

DRILLING ARRANGEMENT AND DRILLING FEED MECHANISM

BACKGROUND OF THE INVENTION

This invention relates to a drilling arrangement and to a drilling feed mechanism.

A number of different drilling feed devices are used in underground mining and in long hole production drilling. Some of these prior art devices are shown in FIGS. 1 to 5 of the attached drawings.

FIG. 1 shows a common drilling feed construction which includes a feed beam 8 with a chain feed 10 wherein a hydraulic or pneumatic motor rotates a chain sprocket wheel 12 either directly or via a reduction gearbox. The chain is connected to a rock drill 14 and linear movement is thereby imparted to a drill rod 16 which passes through a centralizer 18.

It is also known, see FIG. 2, to make use of a screw feed mechanism wherein a suitable motor 20 rotates a threaded bar 22. A threaded bushing 24 which is engaged with the bar is connected to a rock drill 14 so that rotational movement of the bar is translated into linear movement of the rock drill and its drill rod 16.

It is also known to make use of telescopic cylinders to advance a rock drill. Three types of arrangement are known to the applicants.

The first arrangement, shown in FIG. 3, includes a cylinder 26 and first and second pistons 28 and 30 arranged so that the first piston 28 acts as a cylinder tube for the second piston 30. The first piston i.e. the cylinder tube is movable from a protruding position on one side of the cylinder to a protruding position on the other side of the cylinder. The cylinder 26 is directly connected to a rock drill 14 by a mechanical connection 32.

In the second type of arrangement (FIG. 4) an elongate first piston 34 extends substantially for the full length of travel of the rock drill and passes through a cylinder tube 36 which also acts as a second piston located inside a cylinder 38 which is fixed to a rock drill 14.

In a third arrangement, which is shown in FIG. 5, first and second pistons 40 and 42 are again used with the first piston 40 being located inside a cylinder 44 and extending from one end of the cylinder. The first piston acts as a cylinder tube for the second piston 42 which extends from the cylinder tube in the same direction as a drill rod 16 which is attached to a rock drill 14.

A common feature of the aforementioned telescopic cylinder feeds is that one or both of the piston rods are exposed to the front of the rock drill. Rocks and material which are loosened during drilling can fall on to the exposed pistons and damage the pistons or lead to rapid wear of cylinder seals. This results in additional expense and drilling down time. A similar disadvantage exists in respect of the chain and screw feed type device in that the chain and the threaded bar are exposed to material which is loosened during drilling.

It is desirable to have a constant feed force which is exerted by the drilling feed construction on the rock drill. A constant force is achieved fairly readily with a chain feed or a screw feed. However with multistage telescopic cylinder feeds it is necessary to construct the pistons with areas, which are pressurized, of equal magnitude. This in turn imposes limitations on the dimensions of the feed cylinder which can hinder or prevent optimal designs from being produced.

SUMMARY OF THE INVENTION

The invention provides, in the first instance, a drilling arrangement which includes a feed beam, a drill which is mounted for movement relatively to the feed beam and which is engageable with a drill rod which extends in a first direction from the drill, a multistage telescopic cylinder feed mechanism which includes a cylinder which acts on the drill and piston means which extends only in a second direction which is opposite to the first direction and which is telescopically movable relatively to the cylinder only to one side of the cylinder and which, when extending from the cylinder, moves in the second direction, and means on the feed beam for engaging with a protruding end of the piston means.

The piston means may include a first piston mounted inside the cylinder and a second piston mounted inside the first piston.

Use may be made of differential control means for controlling the force which is exerted by the pistons when extending from the cylinder.

The differential control means may comprise any appropriate device and can for example consist of an adjustable sequence valve or a spring loaded and restricted one-way valve, or a shuttle valve.

The differential control means may be located externally of the cylinder, or inside the cylinder and, in the latter case, may be mounted to one of the pistons.

According to a different aspect of the invention there is provided a drilling arrangement which includes a feed beam, a drill which extends in a first direction and which is mounted for movement relatively to the feed beam, a cylinder which acts on the drill, and multistage piston means which extends only in a second direction which is opposite to the first direction and which is telescopically movable relatively to the cylinder only to one side of the cylinder and which, when extending from the cylinder, reacts against the feed beam, thereby moving the drill in the first direction while the piston means moves relatively to the cylinder in the second direction.

The invention also extends to a drilling feed mechanism which includes a cylinder, a first piston which is mounted for relative sliding movement in the cylinder and which has sealing means in sliding contact with an inner wall of the cylinder, a first end on one side of the sealing means, and a reaction surface on an opposed side of the sealing means, a second piston which is mounted for relative sliding movement in the first piston and which has a respective first end and a second end, a first variable volume being formed inside the cylinder and being partly bounded by the respective first ends of the first piston and the second piston, a port to the first variable volume, a second variable volume being formed inside the cylinder and being partly bounded by the reaction surface, a port to the second variable volume, means for pressurizing the first and the second variable volumes via the respective ports, and differential control means for controlling the relative magnitudes of forces which are thereby exerted in opposed directions on the first end of the piston and on the reaction surface respectively.

The differential control means may operate substantially to equalize the magnitudes of the said forces.

The differential control means may be located externally of the cylinder, or inside the cylinder, for example mounted to one of the pistons.

The differential control means may comprise any appropriate device and can for example consist of an adjustable sequence valve or a spring loaded one-way valve.

The invention also provides a drilling arrangement which includes a feed beam, a drill which is mounted for movement relatively to the feed beam, and a drilling feed mechanism of the aforementioned kind, the said cylinder acting on the drill and the said second end of the second piston engaging with the feed beam.

BRIEF DESCRIPTION OF THE DRAWINGS

The invention is further described by way of example with reference to the accompanying drawings in which:

FIG. 6 is a simplified side view of a drilling arrangement according to the invention, FIG. 7 is a simplified cross sectional side view, on an enlarged scale, of a drilling feed mechanism used in the drilling arrangement of FIG. 6, and FIG. 8 and its inset drawing FIG. 9 illustrate a variation of the arrangement shown in FIG. 7.

DESCRIPTION OF PREFERRED EMBODIMENT

Figure 1:
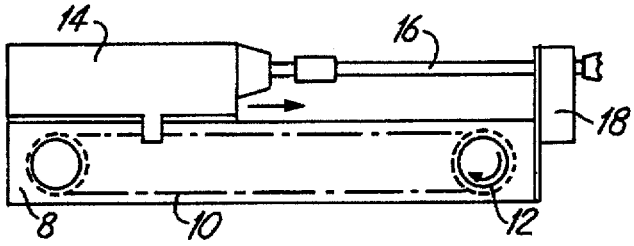
FIGS. 1 to 5 depict prior art devices which have been explained in the preamble to this specification.
Figure 2:
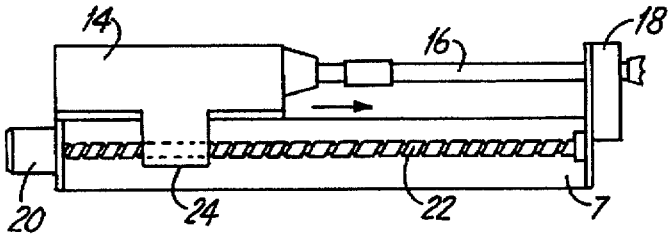
Figure 3:
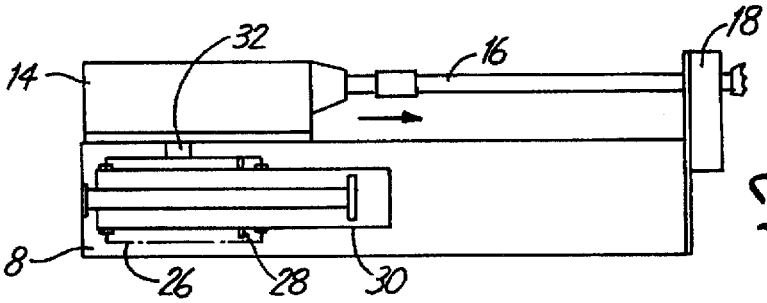
Figure 4:
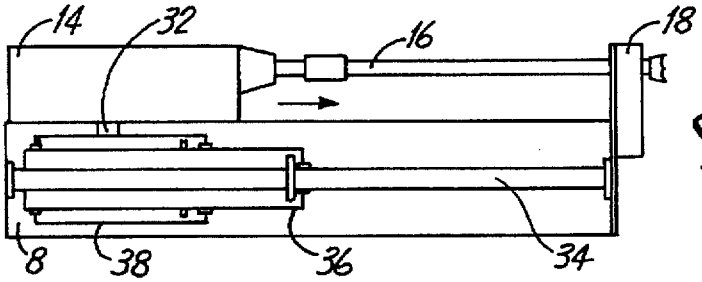
Figure 5:
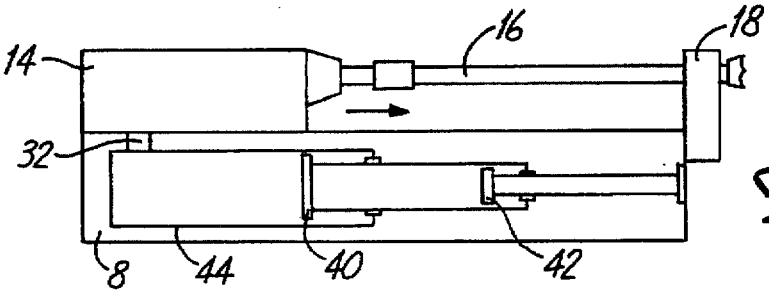

FIG. 6 of the accompanying drawings illustrates a drilling arrangement according to the invention which includes a feed beam 110, a drill 112, a drill rod 114 which extends from the drill and which passes through a drill rod centralizer 116, and a drilling feed mechanism 118.

The mechanism 118 includes a cylinder 120 which is secured to the drill 112 by means of a mechanical connection 121.

FIG. 7 illustrates, on an enlarged scale, the construction of the drilling feed mechanism 118. The mechanism includes the cylinder 120 and, mounted inside the cylinder, a first piston 122 which acts as a cylinder tube for a second piston 124.

The cylinder 120 includes seals 126 which act on an outer surface of the first piston 122. The first piston in turn includes seals 128 and 130 which respectively act on an outer surface of the second piston and on an inner surface of the cylinder. The second piston includes seals 132 which act on an inner surface of the first piston.

The first piston has a first end 134 on one side of the seal 130 and a reaction surface 135 on an opposite side of the seal. The second piston 124 has a first end 136 and a protruding second end 138.

A first variable volume 140 is formed inside the cylinder 120 and is partly bounded by the first ends 134 and 136 of the first and second pistons respectively. A second variable volume 142 is also formed inside the cylinder, on an opposed side of the seal 130 and is partly bounded by the reaction surface 135.

A port 144 is used to connect a hydraulic line 146 to the first variable volume 140. The supply line 146 also extends via a differential control device 148 to a second port 150 which is in communication with the second variable volume 142.

A second hydraulic line 152 leads to an opposed side of the differential control device 148 and to a port 154 near the second end 138 of the second piston. This port extends via an internal passage 156 in the second piston to an exit port 158 which opens into a volume 160 formed between the first piston and the second piston.

The differential control device 148 includes a restricted spring loaded one-way valve 162 and a shuttle valve 164.

Referring to FIG. 6 it is to be noted that the second end 138 of the second piston 124 acts against one end of the feed beam 110 and is fixed thereto.

When the volume 140 is pressurized by hydraulic oil introduced via the supply line 146, a relatively increased pressure is produced in the volume 142 by the action of the spring loaded and restricted check valve 162. By taking into account the relative areas of the first end 134 and the reaction surface 135 and by appropriately varying the pressure difference between the two volumes 140 and 142 the forces on the end 134 and the surface 135 can be controlled to achieve a situation in which:

(a) both pistons are extended in union relatively to the cylinder until the first piston 122 reaches a limiting position, whereupon the second piston 124 extends further, from the first piston, or (b) the second piston 124 extends from the first piston 122 until a limiting position is reached, relatively to the first piston, whereupon the two pistons extend in union from the cylinder.

For example, in situation (b) the forces on the end 134 and on the reaction surface 135 can be equalized so that the extension force is that which arises on the end 136 of the second piston. The extension force remains constant during the piston extension process.

On the other hand it may be preferable to operate with situation (a), for the first piston, which has a larger diameter than the second piston, is relatively stiffer. To achieve this situation the force on the end 134 is slightly greater than the force on the surface 136. However, with this arrangement, there is a slight decrease in the extension force when the first piston reaches the end of its stroke and the second piston then extends from the first piston.

As the second end 138 of the second piston is fixed to the feed beam the aforementioned movement of the drilling feed mechanism is translated into linear movement of the drill 112 in a direction which is opposite to the direction in which the pistons extend relatively to the cylinder 120.

When it is necessary to retract the feed mechanism the line 152 is pressurized. The volume 142 is thereby pressurized and the first piston is moved to the right. Similarly the volume 160 is pressurized and the second piston is moved to the right.

It is to be noted from an examination of FIG. 6 that the pistons 122 and 124 extend only from one side of the cylinder 120. They do not extend from the cylinder in the direction of the drill rod and are, in fact, maintained at positions behind the advancing drill 112. Consequently substantial protection is provided for the pistons by the drill 112 itself. The drill protects the pistons from falling rocks and drill cuttings while drilling is in progress. No inner parts of the feed mechanism are therefore exposed in front of the drill.

In the FIG. 7 arrangement the differential control device 148 is mounted externally of the cylinder. FIGS. 8 and 9 show that it is possible to mount an equivalent device 148A to the first piston 122 inside the cylinder.

The device 148A includes a pilot to open one-way valve 180, a pilot line 184, and a restricting one-way valve 182. The valve 182 could be replaced by a sequence valve. Other components shown in FIGS. 8 and 9 have similar reference numerals to those employed in FIGS. 6 and 7. The device 148A operates in substantially the same way as the device 148 in that the pilot line 184 opens the valve 180 when the volume 140 is pressurized and allows hydraulic oil to flow through the restricting one-way valve 182 to cause a pressure difference, of a desired magnitude, between the two volumes 140 and 142.

The device 148A, being inside the cylinder, is protected and the external construction of the feed mechanism is simplified.

I claim:

1. A drilling arrangement which includes a feed beam (110), a drill (112) which is mounted for movement relatively to the feed beam and which is engageable with a drill rod (114) which extends In a first direction from the drill, and a hydraulic multistage feed mechanism (118) which includes a first cylinder (120) which acts on the drill, a second cylinder (112) which is telescopically movable into or out of the first cylinder and which extends only to one side of the first cylinder, and a piston (124) which is telescopically movable into or out of the second cylinder and which, when extending from the second cylinder, moves in a second direction which is opposite to the first direction, a protruding end (138) of the piston being engaged with means on the feed beam, and which is characterized in that differential control means (148;148A) are provided for controlling the force which is exerted by the hydraulic multistage feed mechanism (118).

2. A drilling arrangement according to claim 1 characterized in that the differential control means (148;148A) controls the said force at a substantially constant value.

3. A drilling arrangement according to claim 1 or 2 characterized in that the differential control means (148) is located externally of the cylinder (120) (FIG. 7).

4. A drilling arrangement according to claim 1 or 2 characterized in that the differential control means (148A) is located inside the cylinder (120) and is mounted at least to the piston (124) (FIGS. 8,9).

* * * * *